US005779737A

United States Patent [19]

Potter et al.

[11] Patent Number: 5,779,737

[45] Date of Patent: Jul. 14, 1998

[54] FIBRE TREATMENT

[75] Inventors: Christopher David Potter; Peter Dobson, both of Derby, United Kingdom

[73] Assignee: Courtaulds Fibres Holdings Limited, United Kingdom

[21] Appl. No.: 702,717

[22] PCT Filed: Apr. 12, 1995

[86] PCT No.: PCT/GB95/00838

§ 371 Date: Sep. 9, 1996

§ 102(e) Date: Sep. 9, 1996

[87] PCT Pub. No.: WO95/28516

PCT Pub. Date: Oct. 26, 1995

[30] Foreign Application Priority Data

Apr. 15, 1994 [GB] United Kingdom ..... 9407496

[51] Int. Cl.[6] ..... D06M 13/41; D06M 13/355

[52] U.S. Cl. ..... 8/194; 8/116.1; 8/181; 8/189; 8/190

[58] Field of Search ..... 8/181, 116.1, 120, 8/189, 191, 193, 190, 495, 542, 930, 194, 196, 125, 192, 543, 544, 546, 547, 548, 549, 497, 538

[56] References Cited

U.S. PATENT DOCUMENTS

| | | |
|---|---|---|
| 2,394,306 | 2/1946 | Hentrich et al. . |
| 2,826,514 | 3/1958 | Schroeder . |
| 2,892,674 | 6/1959 | Sause et al. . |
| 2,971,815 | 2/1961 | Bullock et al. . |
| 3,294,778 | 12/1966 | Randall et al. . |
| 3,383,443 | 5/1968 | Leahy et al. . |
| 3,400,127 | 9/1968 | Tesoro et al. . |
| 3,574,522 | 4/1971 | Rowland et al. . |
| 3,606,990 | 9/1971 | Gobert . |
| 3,663,159 | 5/1972 | Gordon . |
| 3,849,169 | 11/1974 | Cicione et al. . |
| 3,883,523 | 5/1975 | Parton . |
| 3,960,983 | 6/1976 | Blank . |
| 4,090,844 | 5/1978 | Rowland . |
| 4,125,652 | 11/1978 | Komminoth et al. . |
| 4,246,221 | 1/1981 | McCorsley, III . |
| 4,268,266 | 5/1981 | Hendricks et al. . |
| 4,283,196 | 8/1981 | Wenghoefer . |
| 4,336,023 | 6/1982 | Warburton . |
| 4,371,517 | 2/1983 | Vanlerberghe . |
| 4,416,698 | 11/1983 | McCorsley . |
| 4,443,355 | 4/1984 | Murata et al. . |
| 4,472,167 | 9/1984 | Welch . |
| 4,483,689 | 11/1984 | Welch . |
| 4,502,866 | 3/1985 | Brenneisen . |
| 4,563,189 | 1/1986 | Lewis . |
| 4,780,102 | 10/1988 | Harper, Jr. . |
| 4,880,431 | 11/1989 | Yokogawa et al. . |
| 4,908,097 | 3/1990 | Box . |
| 4,971,708 | 11/1990 | Lee . |
| 4,999,149 | 3/1991 | Chen . |
| 5,085,668 | 2/1992 | Pelster et al. . |
| 5,131,917 | 7/1992 | Miyamoto et al. . |
| 5,310,424 | 5/1994 | Taylor . |
| 5,311,389 | 5/1994 | Howey . |
| 5,328,757 | 7/1994 | Kenney et al. . |
| 5,403,530 | 4/1995 | Taylor . |

FOREIGN PATENT DOCUMENTS

| | | |
|---|---|---|
| 40668/78 | 4/1980 | Australia . |
| 044172 | 1/1982 | European Pat. Off. . |
| 174794 | 3/1986 | European Pat. Off. . |
| 252649 | 1/1988 | European Pat. Off. . |
| 538977 | 4/1993 | European Pat. Off. . |
| 1148892 | 12/1957 | France . |
| 1318838 | 2/1963 | France . |
| 2273091 | 12/1975 | France . |
| 1444127 | 9/1969 | Germany . |
| 48-015234 | 5/1973 | Japan . |
| 49-80392 | 8/1974 | Japan . |
| 53-35017 | 4/1978 | Japan . |
| 53-078377 | 7/1978 | Japan . |
| 56-53278 | 5/1981 | Japan . |
| 62-53479 | 3/1987 | Japan . |
| 4-218502 | 8/1992 | Japan . |
| 42-41179 | 8/1992 | Japan . |
| 71100 | 9/1976 | Poland . |
| 543484 | 12/1973 | Switzerland . |
| 576270 | 3/1946 | United Kingdom . |
| 734974 | 8/1955 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 989873 | 4/1965 | United Kingdom . |
| 1142428 | 2/1969 | United Kingdom . |
| 1271518 | 4/1972 | United Kingdom . |
| 1368599 | 10/1974 | United Kingdom . |
| 2007147 | 5/1979 | United Kingdom . |
| 2043525 | 10/1980 | United Kingdom . |
| WO92/07124 | 4/1992 | WIPO . |
| WO92/14871 | 9/1992 | WIPO . |
| WO92/19807 | 11/1992 | WIPO . |
| WO94/09191 | 4/1994 | WIPO . |
| WO94/20656 | 9/1994 | WIPO . |
| WO94/24343 | 10/1994 | WIPO . |
| WO95/30043 | 11/1995 | WIPO . |

OTHER PUBLICATIONS

"Radiopaque Polymers to Safety", Encyclopedia of Polymer Science and Engineering, vol. 14, pp. 45–46, 57–59, John Wiley & Sons, Inc. (1988) (Month Unknown).

"Styrene Polymers to Toys", Encyclopedia of Polymer Science and Engineering, vol. 16, pp. 16 and 685, John Wiley & Sons, Inc. (1989) (Month Unknown).

(List continued on next page.)

*Primary Examiner*—Alan Diamond
*Attorney, Agent, or Firm*—Howson and Howson

[57] ABSTRACT

The present invention relates to a method for reducing the fibrillation tendency of lyocell fibre. Never-dried fibre is treated by an inorganic alkali solution and a chemical reagent having an average of greater than 2.1 acrylamido groups, and then heated. This method produces cellulose materials with a smooth white appearance resistant to creasing in the wet state.

11 Claims, No Drawings

OTHER PUBLICATIONS

R. Moncrieff, "Man–Made Fibres", 6th Edition, 6:882–895, 900–925 (1975) (Month Unknown).
"Textile Resins", in Encyclopedia of Polymer Science and Technology, 16:682–699 (1989) (Month Unknown).
"Dyeing" in Encyclopedia of Polymer Science and Engineering, 5:226–245 (1986) (Month Unknown).
S. Kulkami et al, "Textile Dyeing Operations", pp. 2–3, 84–105 (1986) (Month Unknown).
"Dyes, Reactive" in Kirk–Othmer, Encyclopedia of Chemical Technology, 3rd edition, 8:374–385 (1979) (Month Unknown).
R. Rosenthal, "Genesis Fiber Developed by Courtaulds", Nonwovens Ind., 17(8):33, Paperchem No. 57–06976 (Abstract) (Aug. , 1986).
"New Generation of Cellulose Fibers", Melliand Textilberichte/International Textile Reports, 72(2):94, Textile Technol. Dig. No. 03135/91 (Abstract) (Feb., 1991).
"Lenzing Opens Solvent–Spinning Line for Cellulose Fibres", Nonwovens Rep. Int., 237:6–7, Pira Abstract No. 07–91–00562 (Abstract) (Dec., 1990).
J. Marsh, "An Introduction to Textile Finishing", 2d ed., Chapman and Hall Ltd. (London, 1966), p. 1. (Month Unknown).
Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987), p. 558 (Month Unknown).
R. Moncrieff, "Man–Made Fibres", 5th ed., p. 211 (1970) (Month Unknown).
"Man–Made Fibers Science and Technology", vol. 2, p. 33, Interscience Publishers (1968) (Month Unknown).
E. Flick, "Textile Finishing Chemicals, An Industrial Guide", p. 372 (Mar., 1990).
S. Anand et al, "The Dimensional Properties of Single–Jersey Loop–Pile Fabrics, Part II: Studies of Fabrics with Textured Continuous–filament Yarns in the Ground Structure", J. Text. Inst., 5:349 (1987) (Month Unknown).
A. Hebeish et al, "Chemical Modification of Cotton Through Reaction with Alkoxy Adducts of Acrylamide and Hexahydro–1,3,5–triacryloyl–s–triazine in Nonaqueous Medium", Angew. Makromol. Chem., 91:77–97 (1980) (Abstract only), Chemical Abstract No. CA 94(14):104 742a (Month Unknown).
S. Rowland et al, "Polymerization–crosslinking of N–methylolacrylamide in Cotton Fabric", Text. Res. J., 48(2):73–80 (1978) (Abstract only), Chemical Abstract CA 88(22):154235: (Month Unknown).
M. Solarz, "Modification of Cellulose Fibers with N, N '–methylenebisacrylamide", Przegl. Wlok., 30 (11–12) :546–549 (1976) (Abstract only), Chemical Abstract CA86(20): 141502c (Month Unknown).
M. Kamel et al, Creaction of Reaction Centers on Cotton, III., Synthesis of Some New Methylolacrylamide Derivatives , Kolor. Ert., 17(7–8):217–224(1975) (Abstract only) Chemical Abstract #CA84(5):30360u (Month Unknown).
G. Valk et al, "Creation of Reactive Centers on Cellulose Using Hexahydro–1,3,5–triacryloyl–s–triazine", Text. Res. J., 41(4):364 (1971) (Abstract only), Chemical Abstract #CA75(8):50313y (Month Unknown).
G. Valk et al, "Analysis of High–Grade Finishes, 7., Chemical Detection of the Cross–linking of Cotton with N–acrylamide Derivatives", Melliand Textilber., 51(6):714–719 (1970) (Abstract only), Chemical Abstract #CA73(6):26456K (Month Unknown).
R. Harper, "Crosslinking, Grafting and Dyeing: Finishing for Added Properties", Textile Chemist and Colorist, 23(11):15–20 (Nov., 1991).
"Sulfonation and Sulfation to Thorium and Thorium Compounds" in Kirk–Othmer, Encyclopedia of Chemical Technology, 3rd edition, vol. 22, pp. 769–790 (1983) (Month Unknown).
H. Petersen, "The Chemistry of Crease–Resist Crosslinking Agents", Rev. Prog. Coloration, 17:7–22 (1987) (Month Unknown).
P. Pavlov et al, "Properties of Viscose Fibres Modified in an As–spun State by Cross–Linking", J. Textile Institute, 78(5):357–361 (Sep.–Oct., 1987).
M. Dube et al, "Precipitation and Crystallization of Cellulose from Amine Oxide Solutions", in Proceedings of the Technical Association of the Pulp and Paper Industry, 1983 International Dissolving and Speciality Pulps Conference, TAPPI Press, pp. 111–119 (1983) (Month Unknown).
M. Hurwitz et al, "Dialdehydes as Cotton Cellulose Cross–Linkers", Textile Research Journal, 28(3):257–262 (Mar., 1958).
H. Nemec, "Fibrillation of Cellulosic Materials—Can Previous Literature Offer a Solution?", Lenzinger Berichte, 9:69–72 (Sep., 1994).

FIBRE TREATMENT

This application is a 371 of PCT/GB95/00838 filed Apr. 12, 1995.

1. Field of the Invention

This invention relates to methods of reducing the fibrillation tendency of lyocell fibres.

It is known that cellulose fibre can be made by extrusion of a solution of cellulose in a suitable solvent into a coagulating bath. This process is referred to as "solvent-spinning", and the cellulose fibre produced thereby is referred to as "solvent-spun" cellulose fibre or as lyocell fibre. Lyocell fibre is to be distinguished from cellulose fibre made by other known processes, which rely on the formation of a soluble chemical derivative of cellulose and its subsequent decomposition to regenerate the cellulose, for example the viscose process. One example of the solvent spinning process is described in US-A-4,246,221, the contents of which are incorporated herein by way of reference. Cellulose is dissolved in a solvent such as an aqueous tertiary amine N-oxide, for example N-methylmorpholine N-oxide. The resulting solution is then extruded through a suitable die into an aqueous bath to produce an assembly of filaments, which is washed in water to remove the solvent and is subsequently dried.

Fibres may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Dyed fabric containing fibrillated fibre tends to have a "frosted" appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Lyocell fibre appears to be particularly sensitive to such abrasion and is consequently often found to be more susceptible to fibrillation than other types of cellulose fibre. The present invention is concerned with methods of treatment of lyocell fibre so as to reduce or inhibit its tendency to fibrillate. It has however been found that some such methods of treatment may have detrimental effects on the mechanical properties of the fibre such as its tenacity and extensibility, for example by embrittling the fibre, or on the processability of the fibre and fabric, in particular its dyeability. It can be difficult to identify a method of treatment which provides a satisfactory reduction in fibrillation tendency whilst avoiding such detrimental effects.

2. Background Art

EP-A-538,977 describes a process for providing a solvent-spun cellulose fibre with a reduced fibrillation tendency, in which the fibre is treated with a chemical reagent having two to six functional groups reactive with cellulose. The chemical reagent may be a polyhalogenated polyazine or a compound containing a polyazine ring bearing two or more vinyl sulphone groups or precursors thereof. The fibre may be treated in never-dried or previously-dried form with an aqueous solution of the chemical reagent, which may be made weakly alkaline by the addition of sodium carbonate, sodium bicarbonate or sodium hydroxide. It has however been found that when solvent-spun cellulose fibre is treated with a reagent of the halogenated polyazine type the reduction in fibrillation tendency so obtained tends to be lost when fabric containing the treated fibre is scoured and laundered. Such reagents react with cellulose to form a multiplicity of aromatic/aliphatic ether groups, which are believed to be prone to chemical hydrolysis during fabric processing and laundering. WO-A-94/24343, published 27th October 1994, discloses a closely similar process.

FR-A-2273091 describes a method of manufacturing polynosic viscose rayon fibre with reduced tendency to fibrillation, wherein the fibre is treated in the primary gel state characteristic of polynosic viscose rayon manufacture with a crosslinking agent containing at least two acrylamido groups and an alkaline catalyst at a temperature below 100° C. 1,3,5-triacryloylhexahydro-1,3,5-triazine and N,N'-methylenebisacrylamide are mentioned as preferred examples of crosslinking agent. The dye affinity of the fibre is not modified by this treatment. The process described in FR-A-2273091 suffers from the disadvantage that treatment times in the range 5–15 minutes are required. Such times would be unacceptably long in a fibre production plant, where line speeds are commonly in the range 10–100 m/min, particularly if the fibre is processed in uncut form as tow.

DISCLOSURE OF THE INVENTION

It is an object of the present invention to provide a method of reducing the fibrillation tendency of lyocell fibre which can be carried out rapidly under fibre production conditions. It is a further object of the invention to provide a method of reducing the fibrillation tendency of lyocell fibre whereby the treated fibre retains resistance to fibrillation during subsequent wet processing treatments such as scouring, dyeing and laundering. It is a further object of the invention to provide lyocell fibre having improved dyeability.

According to the present invention there is provided a method for reducing the fibrillation tendency of lyocell fibre, characterised in that (1) there is applied to the fibre in never-dried state an aqueous solution comprising dissolved therein an inorganic alkali and a chemical reagent bearing a plurality of acrylamido groups, the average number of acrylamido groups per molecule of the chemical reagent in the solution being at least 2.1, and (2) the fibre to which the chemical reagent has been applied is heated to produce reaction between the fibre and the chemical reagent.

Examples of suitable inorganic alkalis include sodium hydroxide, sodium silicate and trisodium phosphate (trisodium orthophosphate), which may be preferred. Mixtures of alkalis, for example both sodium hydroxide and trisodium phosphate, may be used.

The chemical reagent preferably bears three acrylamido groups (—NHCOCH=$CH_2$ groups) and is preferably 1,3,5-triacryloylhexahydro-1,3,5-triazine. It is believed that the hydroxyl groups in the cellulose molecules react by Michael addition with the acrylamido groups in the chemical reagent, thereby crosslinking the cellulose molecules. The solution may in general contain 5 to 50, preferably 10 to 20, grams per litre of the chemical reagent. It has been found that chemical reagents of this type tend to hydrolyse in alkaline aqueous solution, particularly at high pH and during prolonged storage or when long application times are used. It has been found that if the degree of hydrolysis is excessive, such that the average number of acrylamido groups per molecule in the solution when it is applied to the fibre is less than about 2, then the protection against fibrillation afforded by treatment with the chemical reagent is small or lacking. The average number of acrylamido groups per molecule in the solution may also be referred to as the functionality of the reagent. It is preferably at least 2.2, further preferably at least 2.5. For a reagent bearing three acrylamido groups, it is desirable for the functionality of the reagent to be close to 3, but in practice hydrolysis in the solution may result in the functionality being no more than 2.9 or 2.7. It has further been found that chemical reagents which initially contain only two acrylamido groups give a less satisfactory reduction in fibrillation tendency than chemical reagents which initially contain three or more acrylamido groups.

The pH of the solution containing alkali and chemical reagent is preferably in the range 11 to 14, more preferably in the range 11.5 to 12.5. It has been found that the rate of reaction may be undesirably slow if the pH is below the preferred range. It has further been found that the rate of hydrolysis of the functional groups in the chemical reagent may be undesirably rapid if the pH is above the preferred range. The concentration of the inorganic alkali in the solution is chosen to set the pH of the solution at a desired value. The concentration of inorganic alkali in the solution is generally in the range from about 1 to about 100 grams per litre, preferably about 20 to about 50 grams per litre for a mild alkali such as trisodium phosphate or about 2 to about 10 grams per litre for a caustic alkali such as sodium hydroxide.

Fibre treated by the method of the invention often contains 0.25 to 3 percent by weight of the chemical reagent bonded (fixed) to cellulose, based on the weight of air-dry fibre. The amount of fixed reagent may be assessed for example by measurement of the nitrogen content of the fibre. It has surprisingly been found that useful protection against fibrillation can be obtained with amounts of fixed reagent as low as 0.25 to 1 percent. This is advantageous in that chemical reagents suitable for use in the invention are often expensive, so that it is desirable to minimise the amount used. An amount of fixed reagent in the range 0.4 to 0.8 percent may be found to provide a useful balance between protection against fibrillation and expense. It has also been found that fibre treated according to the method of the invention in general has a dye affinity at least as high as that of untreated fibre. This is remarkable, in that crosslinking treatments generally reduce the dyeability of cellulosic fibres. It has further and surprisingly been found that fibre containing 1 to 3 percent fixed reagent exhibits an advantageously higher dyeability than untreated fibre with some dyestuffs, for example certain direct and reactive dyestuffs. The invention accordingly further provides a method for increasing the dyeability of lyocell fibre, characterised in that (1) there is applied to the fibre in never-dried state a solution comprising dissolved therein an inorganic alkali and a chemical reagent bearing a plurality of acrylamido groups, and (2) the fibre to which the chemical reagent has been applied is heated to produce reaction between the fibre and the chemical reagent, thereby fixing to the fibre 1 to 3 percent by weight of the chemical reagent based on the weight of air-dry fibre.

The aqueous solution used in the method of the invention may additionally contain sodium sulphate, preferably at a concentration in the range of 10 to 50 grams per litre calculated as the anhydrous salt. It has been found that addition of sodium sulphate may improve the efficiency and/or speed of reaction of the chemical reagent with cellulose.

The method of the invention may be performed by passing the lyocell fibre through an aqueous circulating bath containing both the inorganic alkali and the chemical reagent. The chemical reagent may be liable to hydrolysis in such a circulating bath, and the volume of the bath is therefore preferably as small as possible. Alternatively, separate solutions of the inorganic alkali and the chemical reagent may be mixed shortly before application to the fibre and may be applied to the fibre by padding or spraying, for example. In a further alternative, such separate solutions may be applied individually to the fibre. In this procedure, which may be preferred, the first solution may be applied to the fibre, for example from a circulating bath or by padding or spraying, optionally followed by mangling to express excess liquor, and the second solution may then be applied to the fibre, for example by padding or spraying. The separate solutions may be applied to the fibre in either order. If sodium sulphate is employed, the sodium sulphate may be contained in either of the separate solutions. The temperature of the solution is generally chosen having regard to the requirement that the chemical reagent be applied to the fibre in the dissolved state and is often in the range from ambient temperature to 60° C.

It will be recognised that, after application of the solution of the chemical reagent to the fibre, the pH of the liquor in contact with the fibre will generally be less than that of the solution before application, because of the buffering effect of the carboxylic acid groups generally present in cellulose molecules. Accordingly, when separate solutions of the inorganic alkali and the chemical reagent are applied to the fibre, the pH of the liquor in contact with the fibre will not necessarily be in the range preferred for a single solution before application to the fibre. If this procedure is employed, the pH of the aqueous solution containing an inorganic alkali and a chemical reagent bearing a plurality of acrylamido groups referred to hereinabove is defined as being the pH of the mixture of the separate solutions in the proportions in which they are applied.

After application of the inorganic alkali and the chemical reagent in aqueous solution to the fibre, the wetted fibre is subjected to the fixation step to produce reaction between the fibre and the chemical reagent. The temperature of heat treatment is considered to be the maximum temperature attained during the fixation step. It is usually at least about 50° C., may be at least about 80° C., and may be up to about 100° C. or more up to about 140° C. The fibre to which the solution has been applied is preferably heated to above the temperature of the application step, for example by steaming or by microwaves, to induce reaction between the cellulose and the chemical reagent. Dry heat is generally less preferred. The total time of treatment (application plus fixation) is generally less than 3 minutes, preferably less than 2 minutes, more preferably less than 1 minute. This short treatment time is a particular advantage of the invention. A further advantage of the invention is the efficient use of the chemical reagent.

After treatment with the alkaline solution of chemical reagent according to the method of the invention, the fibre is washed and dried. This washing stage preferably includes washing with dilute aqueous acid so that the pH of the dried fibre is in the range from about 4.5 to about 6.5.

The invention further provides a method for the manufacture of lyocell fibre with a reduced tendency to fibrillation, which includes the steps of:

(a) dissolving cellulose in a solvent to form a solution, the solvent being miscible with water;

(b) extruding the solution through a die to form a fibre precursor;

(c) passing the fibre precursor through at least one aqueous bath to remove the solvent and form the fibre;

(d) applying to the fibre an aqueous solution which comprises an inorganic alkali and a chemical reagent bearing a plurality of acrylamido groups in aqueous solution, the average number of acrylamido groups per molecule of chemical reagent in the solution being at least 2.1;

(e) heating the fibre at a temperature of at least 50° C. so as to induce reaction between the chemical reagent and the fibre;

(f) washing the fibre; and (g) drying the fibre.

The fibre at the end of step (c) and in steps (d) and (e) is never-dried fibre and generally has a water imbibition in the range 120–150%.

The invention further provides a method for reducing the fibrillation tendency of lyocell fibre, characterised in that the fibre is treated in the never-dried state at a temperature of at least about 50° C. with an inorganic alkali and a chemical reagent bearing at least three acrylamido groups in aqueous solution, the pH of the solution before application to the fibre being in the range 11.5 to 14, preferably 11.75 to 12.5.

It is an advantage of the invention that it can be carried out in a production plant for the manufacture of lyocell fibre at line speeds, that is to say on a fibre tow in extended form. The fibre is protected against fibrillation at an early stage, in particular before wet processing of the dried lyocell fibre or of fabric made therefrom, for example woven or knitted fabric. Such wet processing operations include scouring, dyeing and laundering.

The invention is illustrated by the following Examples. Materials may be assessed for degree of fibrillation using the method described below as Test Method 1 and assessed for fibrillation tendency using the technique described below as Test Method 2 or 2A.

Test Method 1 (Assessment of Fibrillation)

There is no universally accepted standard for assessment of fibrillation, and the following method was used to assess Fibrillation Index (F.I.). A series of samples of fibre having nil and increasing degrees of fibrillation was identified. A standard length of fibre from each sample was then measured and the number of fibrils (fine hairy spurs extending from the main body of the fibre) along the standard length was counted. The length of each fibril was measured, and an arbitrary number, being the number of fibrils multiplied by the average length of each fibril, was determined for each fibre. The fibre exhibiting the highest value of this arbitrary number was identified as being the most fibrillated fibre and was assigned an arbitrary Fibrillation Index of 10. The wholly unfibrillated fibre was assigned a Fibrillation Index of zero, and the remaining fibres were graded from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

In general, fabrics containing fibre with F.I. 2 or more may have a "frosted" appearance. A desirable target for fibre F.I. is 1 or less, preferably 0.5 or less, in fabric, including laundered fabric.

Test Method 2 (Inducement of Fibrillation)

A) Scouring Treatment. 1 g fibre was placed in a stainless steel cylinder approximately 25 cm long by 4 cm diameter and having a capacity of approximately 250 ml. 50 ml conventional scouring solution containing 2 g/l Detergyl FS955 (an anionic detergent available from ICI plc) (Detergyl is a Trade Mark) and 2 g/l sodium carbonate was added, a screw cap was fitted and the capped cylinder was tumbled end-over-end at 60 tumbles per minute for 60 minutes at 95° C. The scoured fibre was then rinsed with hot and cold water.

B) Blender Treatment. 0.5 g scoured fibre cut into 5–6 mm lengths and dispersed in 500 ml water at ambient temperature was placed in a household blender (liquidiser) and the blender run for 2 minutes at about 12000 rpm. The fibre was then collected and dried and assessed for degree of fibrillation using Test Method 1.

Test Method 2A (Inducement of Fibrillation)

This is the same as Test Method 2 but with the omission of the scouring treatment (A).

Test Method 3 (Fibre Treatment)

The following general procedure was employed for assessment of fibre treatment conditions. A solution of cellulose in aqueous N-methylmorpholine N-oxide (NMMO) was extruded into an aqueous coagulation bath to form 1.7 decitex lyocell filaments, which were washed with water until they were substantially free of NMMO. These never-dried lyocell filaments or fibres were swirled in a hot aqueous bath containing 1,3,5-triacryloylhexahydro-1,3,5-triazine (TAHT) and alkali as stated below, rinsed with 0.5 ml/l aqueous acetic acid and dried.

Test Method 4 (Fibre Treatment)

The following general procedure was employed for assessment of fibre treatment conditions. A solution of cellulose in aqueous N-methylmorpholine N-oxide (NMMO) was extruded into an aqueous coagulation bath to form 1.7 decitex lyocell filaments, which were washed with water until they were substantially free of NMMO. These never-dried filaments were then passed through an application unit containing 1,3,5-triacryloylhexahydro-1,3,5-triazine (TAHT) and alkali and in some cases sodium sulphate. The filaments were then squeezed in a nip before passage into a steam environment for fixation of the TAHT to the fibre. The duration of steaming was in the range 1 to 2 minutes unless otherwise stated. The filaments were then washed in water or dilute acid followed by water to remove any unwanted treatment chemicals.

Test Method 5 (Measurement of TAHT Concentration and Functionality)

The following method can be used to assess the average number of acrylamido groups per molecule (functionality) in aqueous solutions which comprise TAHT and its hydrolysis products, as well as the concentration of TAHT in such solutions. It has been found that the UV spectrum of TAHT exhibits absorption peaks at 195 and 230 nm, and the UV spectrum of its hydrolysis products peaks at 195 nm. Absorbance measurements may conveniently be made using solutions containing 5 to 20 mg/l TAHT at 10 mm path length. More concentrated solutions may be diluted with water before measurement. The concentration of TAHT in an aqueous solution can be determined by comparison of the absorbance measured at 230 nm against a calibration curve obtained using solutions in pure water of known concentration. It has been found experimentally that the average functionality in a solution which comprises TAHT and its hydrolysis products can be estimated by means of the equation:

$$F=(A_{230}/A_{195}-0.057)/0.1423$$

wherein F represents functionality and $A_{230}$ and $A_{195}$ respectively represent the absorbances measured at 230 and 195 nm.

The concentration and functionality of other chemical reagents bearing a plurality of acrylamido groups can be determined by experimentally proven methods designed in similar manner.

EXAMPLE 1

Never-dried lyocell filaments (1.7 dtex) were treated according to Test Method 4. Filaments (134 g/min) were passed through an aqueous bath containing 1,3,5-triacryloyl-hexahydro-1,3,5-triazine (TAHT), sodium sulphate (nominally 20 g/l) and trisodium phosphate (TSP). This bath was maintained at steady state (at a TAHT concentration of 10.8–16.0 g/l, a TSP concentration of 15.8–20.5 g/l, a temperature of 46°–51° C. and pH 11.6 to 12.0) by addition of solid TAHT (3.4 gl/min) and TSP (5.8 g/min) and sodium hydroxide solution (5% solution) to the circulating liquor using an in-line high shear mixer/pump. (The functionality of the TAHT was assessed by Test Method 5.) The fibre was then squeezed in a nip before being exposed to saturated steam for 2 minutes. The fibre was then washed and dried and assessed for fibrillation tendency according to Test Methods 1 and 2. The amount of TAHT fixed was assessed by Kjeldahl nitrogen analysis. The results are given in Table 1.

TABLE 1

| Run Time, minutes | Functionality | TAHT % owf | Fibrillation Index |
|---|---|---|---|
| 0 | 2.53 | 0.6 | 0.3 |
| 40 | 2.42 | 0.8 | 0.1 |
| 80 | 2.43 | 0.9 | 0.3 |
| 120 | 2.36 | 0.7 | 0.5 |
| 160 | 2.60 | 0.7 | 0.5 |

(owf = on weight of fibre, i.e. by weight on treated air-dry fibre)

It can be seen that a very good level of fibrillation protection was achieved under these treatment conditions with fixed TAHT levels as low as 0.6%.

EXAMPLE 2

Alternative Alkalis

Test Method 4 was employed using an aqueous bath containing TAHT (15 g/l) and a variety of alkalis. Full details are given in Table 2.

TABLE 2

| Aikali, g/l | pH | TAHT % on fibre weight | Fixation Efficiency % |
|---|---|---|---|
| Trisodium Phosphate 20 g/l | 11.79 | 0.71 | 63 |
| Sodium Hydroxide 5 g/l | 11.46 | 1.03 | 77 |
| Sodium Metasilicate 10 g/l | 11.77 | 0.66 | 57 |

TABLE 2-continued

| Aikali, g/l | pH | TAHT % on fibre weight | Fixation Efficiency % |
|---|---|---|---|
| Sodium Metasilicate 20 g/l and Sodium Sulphate 20 g/l | 12.6 | 1.01 | 100 |

This illustrates that a range of alkalis can be used in the method of the invention. Fixation efficiency is the proportion of the chemical reagent bonded to the air-dry fibre relative to the amount present on the fibre after the application step.

EXAMPLE 3

Test Method 3 was employed, using a bath containing 40 g/l TAHT and 30 g/l TSP (trisodium orthophosphate) at 80° C. for 30 seconds. In one series of experiments the bath additionally contained 50 g/l sodium sulphate decahydrate (Glauber's salt). The fibre was then treated for another 30 seconds in various ways as shown in Table 3. Fibrillation was induced by Test Method 2 and assessed by Test Method 1. Results are shown in Table 3:

TABLE 3

| | TAHT % in Treated Fibre | | |
|---|---|---|---|
| Treatment | 0 g/l $Na_2SO_4$ | 50 g/l $Na_2SO_4$ | F.I. |
| Control | 0.00 | 0.00 | 6.4 |
| Ambient | 2.68 | 3.49 | 0.0 |
| 110° C. Oven | 3.52 | 4.77 | 0.0 |
| 98° C./100% R.H. Steam | 4.26 | 5.64 | 0.0 |

(R.H. = relative humidity)

Zero fibrillation was observed in this experiment when using TAHT whether sodium sulphate was used or not. Addition of sodium sulphate increased the degree of fixation of TAHT.

EXAMPLE 4

An aqueous solution containing 40 g/l TAHT and an inorganic alkali was padded onto never-dried lyocell fibre at 80° C., and the fibre was steamed at 98° C./100% R.H. for 1 minute, rinsed with 0.5 ml/l aqueous acetic acid and dried. Fibrillation was induced by Test Method 2 and assessed by Test Method 1. The results are shown in Table 4:

TABLE 4

| Alkali | Concentration g/l | pH | $Na_2SO_4$ g/l | TAHT | F.I. |
|---|---|---|---|---|---|
| Control | — | — | — | 0.00 | 6.2 |
| TSP | 30 | 11.9 | 0 | 2.65 | 1.0 |
| TSP | 30 | — | 50 | 3.13 | 0.2 |
| NaOH | 10 | 13.4 | 0 | 2.70 | 0.0 |
| NaOH | 20 | 13.7 | 0 | 2.54 | 0.6 |

An excellent reduction in fibrillation tendency was observed in all cases.

EXAMPLE 5

Use of Sodium Hydroxide. Test Method 4 was employed, using an aqueous bath at 50° C. containing TAHT (15 g/l)

and sodium hydroxide at varying concentration (as shown in Table 5).

TABLE 5

| Sodium Hydroxide g/l | TAHT, % on fibre weight | Fixation Efficiency, % |
|---|---|---|
| 2 | 0.25 | 28 |
| 3 | 0.42 | 83 |
| 3.5 | 0.51 | 61 |
| 4 | 0.55 | 74 |
| 4.5 | 0.74 | 74 |
| 5 | 0.73 | 64 |
| 6 | 0.53 | 64 |

EXAMPLE 6

Never dried lyocell filaments (1.7 dtex) were passed (134 g/min) through an aqueous bath (temperature 52°–56° C., pH 12.0–12.4) containing 1,3,5-triacryloylhexahydro-1,3,5-triazine (TAHT) (initially 17 g/l), sodium sulphate (initially 17 g/l) and sodium hydroxide (initially 3.5 g/l). Solid reagents and sodium hydroxide solution were added to the circulating liquor during the course of the trial with the intention of maintaining constant conditions except as occasioned by the hydrolysis of TAHT. The functionality of TAHT in the solution was measured by Test Method 5. The fibre was then squeezed in a nip before being exposed to saturated steam for 2 minutes. The fibre was then washed and dried and assessed for fibrillation according to Test Methods 1 and 2. The TAHT fixation level was assessed by Kjeldahl nitrogen analysis. The results are given in Table 6.

TABLE 6

| Run Time minutes | Functionality | pH | TAHT % on fibre weight | Fibrillation Index |
|---|---|---|---|---|
| 0 | — | 12.3 | 2.11 | 0.0 |
| 10 | 2.2 | 12.4 | 2.54 | 0.0 |
| 20 | — | 12.2 | 1.88 | 0.4 |
| 30 | 1.6 | 12.2 | 1.84 | 2.1 |
| 40 | — | 12.2 | 1.87 | 1.7 |
| 50 | 1.2 | 12.1 | 1.10 | — |
| 60 | — | 12.2 | 1.10 | 4.9 |
| 70 | 0.8 | 12.1 | — | — |
| 80 | — | 12.1 | 0.97 | 5.4 |
| 90 | 0.6 | 12.1 | — | — |
| 100 | — | 12.0 | 1.01 | 4.9 |

Under these conditions TAHT suffered excessive hydrolysis in the treatment bath after the first few minutes, so that the samples at longer run times represent comparative examples. The protection against fibrillation afforded by the treatment declined with increasing run time. The fibrillation Index of the later samples was unacceptably high, even though an appreciable amount of TAHT had been fixed onto the fibre. It will be appreciated that even less protection would be afforded by the low TAHT fixation levels (less than 1%) desirable for commercial reasons.

EXAMPLE 7

This experiment was designed to assess the effect of steaming time. Test Method 4 was followed using an treatment solution comprising TAHT (15 g/l) and trisodium phosphate (20 g/l). The results are given in Table 7.

TABLE 7

| Steaming Time, seconds | Fixation efficiency, % |
|---|---|
| 60 | 48 |
| 77 | 55 |
| 92 | 62 |
| 108 | 65 |
| 126 | 65 |

The results illustrate that under the conditions used for this treatment fixation efficiency reached a plateau at steaming times of about 90 seconds and above. Shorter fixation time may be achievable by quickly preheating the tow prior to steaming or with the use of microwaves.

EXAMPLE 8

Fixation using microwaves. Test Method 4 was employed using TAHT (15 g/l) and trisodium phosphate (20 g/l) at 50° C. Samples were treated batchwise and fixed for varying times using a 700 W microwave oven, instead of steaming. Results are given in Table 8.

TABLE 8

| Microwave Time Seconds | TAHT % on fibre weight | Fixation Efficiency | Fibrillation Index |
|---|---|---|---|
| 15 | 0.2 | 21 | 1.8 |
| 30 | 0.5 | 54 | 1.9 |
| 50 | 0.4 | 36 | 1.2 |
| 60 | 0.6 | 66 | 0.1 |
| 60 (repeat) | 1.0 | 97 | 0.0 |
| 180 | 1.1 | 100 | 0.0 |

Excellent fibrillation protection was achieved with amounts of fixed TAHT as low as 0.6% on fibre weight.

EXAMPLE 9

Test Method 4 was followed using an aqueous solution of TAHT and trisodium phosphate, using feeds of TAHT, trisodium phosphate and sodium hydroxide to maintain a steady state with respect to concentrations and pH (12.8–13.9 g/l TAHT, 20.3–26.0 g/l TSP, pH 11.79–11.95) under conditions chosen to minimise hydrolysis of TAHT.

The fibre to which the solution had been applied was passed through a nip to express excess liquor, crimped by passage through a stuffer box, and plaited into a steaming box (J-box). A first steam hose was connected to the steaming box 7.5 minutes after the start of the trial, and a second hose was connected 14 minutes after the start of the trial. After 20 minutes'running time, the temperature inside the steaming box was consistently about 100° C., as measured by a thermocouple at various positions. Fibre residence time in the steaming box was about 10 to 15 minutes. Results on fibre samples taken at various running times after the system had stabilised are shown in Table 9.

TABLE 9

| Running Time minutes | TAHT % on fibre weight | Fixation Efficiency % | Fibrillation Index |
|---|---|---|---|
| 20 | 1.07 | 83 | 0.8 |
| 25 | 1.07 | 74 | 0.3 |
| 27.5 | 0.90 | 71 | 0.9 |
| 30 | 0.88 | 81 | 1.3 |

EXAMPLE 10

Never-dried fibre was treated with TAHT by Test Method 3 using a range of TAHT solution concentrations to give a range of TAHT levels fixed on fibre. Treatment was carried out using a John Jeffries Hank Dyer with 20 g/l TSP at a temperature of 80° C. and liquor-to-goods ratio 20:1 for 30 minutes. Physical properties of the treated fibres are given in Table 10.

TABLE 10

| TAHT % in solution | TAHT % owf | Water Inhibition % | Tenacity CN/tex Wet | Tenacity CN/tex Dry | Extension at Break % Wet | Extension at Break % Dry |
|---|---|---|---|---|---|---|
| — | — | 61 | 35.3 | 40.3 | 15.6 | 13.7 |
| 1.25 | 0.42 | 64 | 31.2 | 40.3 | 15.0 | 12.9 |
| 2.4 | 0.97 | 72 | 27.7 | 38.6 | 11.9 | 13.5 |
| 4.5 | 1.93 | 81 | 26.1 | 38.8 | 11.0 | 11.2 |

The results indicate a small reduction in tenacity and extensibility with increasing TAHT level. This reduction is considered acceptable for textile applications. Remarkably, water imbibition increased with increasing TAHT fixation level. This may indicate that crosslinking of the fibre in swollen form increases the ability of the dried fibre to absorb water when rewetted. This ability to control water imbibition is an advantage of the invention.

EXAMPLE 11

Never-dried lyocell fibre was treated with TAHT by Test Method 4 (2.1–1.5 g/l TAHT, nominal 20 g/l TSP, pH 11.84–11.49) to provide fibre samples containing 1.6–2.0% fixed TAHT. These samples were spun into yarn and the yarn woven into fabric. These fabric samples and an untreated control were dyed with direct dyes using the following conditions:

Liquor-to-goods ratio 10:1, liquor temperature 50° C., amount of dye 3% owf. Immerse the fabric in the dye bath, run 10 minutes. Add NaCl to give 4 g/l, run 10 minutes. Raise temperature to 95° C. over 30 minutes, add NaCl to give a total of 20 g/l, run 30 minutes. Cool to 80° C. over 10 minutes, run 15 minutes. Rinse fabric with hot and cold water, spin dry, and dry.

Dye bath liquors were sampled throughout the dyeing process and analysed by visible spectroscopy to determine the rate of dye uptake. Results, expressed as percentage depletion of dye in the bath in comparison with the amount initially present, are shown in Table 11.

TABLE 11

| Dye | Solophenyl Orange 4HL | | Solophenyl Violet 4HL | | Solar Black G | | Solar Green HL | |
|---|---|---|---|---|---|---|---|---|
| Time minutes | Untreated | Treated | Untreated | Treated | Untreated | Treated | Untreated | Treated |
| 0 | 0 | 0 | 0 | 0 | 0 | 0 | 0 | 0 |
| 10 | 0 | 25 | 5 | 8 | 4 | 0 | 0 | 10 |
| 20 | 0 | 11 | 10 | 10 | 13 | 0 | 0 | 20 |
| 50 | 24 | 26 | 69 | 61 | 58 | 54 | 33 | 63 |
| 90 | 30 | 52 | 58 | 90 | 65 | 64 | 36 | 61 |
| 115 | 34 | 74 | 62 | 90 | 64 | 66 | 61 | 84 |

In these and other experiments the rates of dye uptake for untreated and treated lyocell were similar. The main difference was in the depth of shade. In many cases the treated lyocell dyed to a deeper shade (absorbed more dye) than untreated lyocell. This is advantageous both for the possibility of cost savings and for that of dyeing to deeper shades.

The deeper shades can be described quantitatively using relative colour depth values (Q-values). Q-value is the relative depth of colour of a sample against a particular standard sample whose depth of colour is given the value 100. The depth of colour of a surface can be expressed as the integral of K/S over the range 400 to 700 nm, where K is the absorption coefficient and S is the scattering coefficient. K/S can be calculated from the reflectance value of a surface at a particular wavelength. The integral of K/S is proportionally related to the amount of dye in a fabric. In colour comparison of fabrics dyed with a single dye, a difference in Q-value of 5% or more will in general be visibly different to the naked eye. The Q-values are given in Table 12, and are quoted for the TAHT-treated samples relative to the corresponding untreated samples. Dye uptake represents the proportion of dyestuff on the fibre compared with the amount initially present in the dye bath.

TABLE 12

| | Dye Uptake % Untreated | Dye Uptake % TAHT-treated | Relative Q-value % |
|---|---|---|---|
| Solar Red B | 72 | 58 | 111 |
| Solophenyl Violet 4BL | 58 | 90 | 138 |
| Solar Black G | 65 | 64 | 102 |
| Solar Green BL | 36 | 61 | 153 |
| Solophenyl Orange ARL | 30 | 53 | 132 |
| Solophenyl Blue AGFL | 64 | 78 | 113 |

It can be seen that in several cases lyocell fibre treated by the method of the invention dyed to a deeper shade than untreated fibre, this generally corresponding to the absorption of a larger quantity of dye.

EXAMPLE 12

Never-dried lyocell fibre in tow form was treated with TAHT by Test Method 3 to provide samples with various amounts of TAHT fixed on fibre. Dried lyocell fibre was treated with TAHT in analogous manner. Treatment was carried out using a John Jeffries Hank Dyer with 20 g/l TSP at a temperature of 80° C. and liquor-to-goods ratio 22:1 for 30 minutes. The samples were then dyed using Direct Green 26 (1% owf), and the dyed samples were assessed for Q-value against untreated previously-dried lyocell tow as standard. The results are given in Table 13.

TABLE 13

| TAHT conc | TAHT Fixed | Relative Q-values | |
|---|---|---|---|
| g/l | % | Never Dried | Dried |
| 0.5 | 0.10 | | 98 |
| 0.5 | 0.13 | 100 | |
| 1.0 | 0.27 | | 99 |
| 1.0 | 0.38 | 102 | |
| 2.0 | 0.64 | | 100 |
| 2.0 | 0.84 | 100 | |
| 4.0 | 1.77 | | 97 |
| 4.0 | 1.83 | 108 | |
| 5.0 | 2.02 | | 96 |
| 5.0 | 2.19 | 106 | |
| 7.0 | 2.65 | | 101 |
| 7.0 | 3.59 | 105 | |
| 10.0 | 3.99 | | 93 |
| 10.0 | 5.48 | 107 | |

The TAHT-treated dried fibres all dyed to paler shades than the TAHT-treated never-dried fibres. Also all of the fibres treated with TAHT in never-dried state dyed deeper than the untreated control.

EXAMPLE 13

Never-dried lyocell fibre was treated with TAHT according to Test Method 4 (2.1–1.5 g/l TAHT, nominal 20 g/l TSP, pH 11.84–11.49) to provide fibre samples containing 1.6–2.0% fixed TAHT. These samples were spun into yarn and the yarn woven into fabric. These fabric samples and fabric made from untreated lyocell fibre were dyed with a range of reactive dyes. The dyeing regime is set out below:

| | |
|---|---|
| Start at 25° C. with dye (1.1% dye by weight on fibre) | Sample 1 |
| Run 10 minutes | |
| Raise to 80° C. over 30 minutes, add $Na_2SO_4$ in portions | Sample 2 |
| Run 20 minutes, add $Na_2CO_3$ over 10 minutes | Sample 3 |
| Run 15 minutes | Sample 4 |
| Run 45 minutes | Sample 5 |

Fabric samples were taken at various times, rinsed in cold water and soaped off. The amount of dyestuff in the various liquors was assessed by visible spectroscopy. The percentage depletion of dyestuff into the fibre from the dye bath was assessed from the amount of dye remaining in the dye liquor and is referred to as exhaustion. The percentage of the dyestuff on the fibre after rinsing which remained in the fibre after soaping-off was assessed by relative colour intensity measurement using visible spectroscopy. The results are given in Table 14

TABLE 14

| | | Exhaustion % | | Fixation % | |
|---|---|---|---|---|---|
| Sample No. | Time Minutes | Control | TAHT-treated | Control | TAHT-treated |
| Procion Yellow HE4R | | | | | |
| 1 | 10 | 6 | 13 | 1 | 2 |
| 2 | 40 | 68 | 90 | 13 | 9 |
| 3 | 60 | 75 | 94 | 21 | 17 |
| 4 | 85 | 80 | 96 | 77 | 97 |
| 5 | 130 | 75 | 97 | 74 | 85 |

TABLE 14-continued

| | | Exhaustion % | | Fixation % | |
|---|---|---|---|---|---|
| Sample No. | Time Minutes | Control | TAHT-treated | Control | TAHT-treated |
| Procion Red HE7B | | | | | |
| 1 | 10 | 6 | 19 | 1 | 2 |
| 2 | 40 | 68 | 79 | 19 | 13 |
| 3 | 60 | 69 | 83 | 21 | 23 |
| 4 | 85 | 72 | 88 | 69 | 85 |
| 5 | 130 | 76 | 94 | 73 | 80 |

Results using Procion Yellow HE4R and Procion Red HE7B are typical. (Procion is a Trade Mark of ICI plc) The rates of exhaustion were faster for TAHT-treated fabric and exhaustion continued to a higher level. The rate of fixation of the dye was similar on the two fabrics, but the final fixation level of the TAHT-treated fabric was higher than that of the control lyocell fabric.

Thus the TAHT-treated fabric exhibited a higher efficiency in dyestuff usage than the control. Further, the TAHT-treated fabric dyed to a deeper shade than the control. In view of the more rapid exhaustion for the TART-treated fabric, shorter dyeing cycles can be envisaged.

We claim:

1. A method for reducing the fibrillation tendency of lyocell fibre, comprising in a continuous process the steps of (1) applying to the fibre in never-dried state an aqueous solution comprising dissolved therein an inorganic alkali and a chemical reagent bearing a plurality of acrylamido groups, the average number of acrylamido groups per molecule of the chemical reagent in the solution being greater than 2.1, and (2) heating the fibre to which the chemical reagent has been applied to produce reaction between the fibre and the chemical reagent.

2. A method according to claim 1, wherein after reaction the fibre comprises fixed to the fibre 0.25 to 1 percent by weight of the chemical reagent based on the weight of air-dry fibre.

3. A method according to claim 1, wherein after reaction the fibre comprises fixed to the fibre 0.4 to 0.8 percent by weight of the chemical reagent based on the weight of air-dry fibre.

4. A method according to claim 1, wherein the average number of acrylamido groups per molecule of the chemical reagent in the solution is at least 2.5.

5. A method according to claim 1, wherein the solution comprises 5 to 50 grams per litre of the chemical reagent.

6. A method according to claim 1, wherein the chemical reagent comprises 1, 3, 5-triacryloylhexahydro-1, 3, 5-triazine.

7. A method according to claim 1, wherein the inorganic alkali comprises trisodium orthophosphate.

8. A method according to claim 1, wherein the pH of the solution is in the range 11 to 14.

9. A method according to claim 1, wherein the solution additionally comprises 10 to 50 grams per liter sodium sulphate calculated as sodium sulphate decahydrate.

10. A method according to claim 1, wherein the temperature of the heating step is in the range from about 80° to about 100° C.

11. A method according to claim 1, wherein the total time occupied by the application and heating steps is less than 2 minutes.

* * * * *